United States Patent [19]

Perez

[11] 4,040,192

[45] Aug. 9, 1977

[54] ATHLETIC TRAINING SHOE

[76] Inventor: Jose Miguel Perez, 7975 NW. 17th Terrace, Miami, Fla. 33155

[21] Appl. No.: 694,025

[22] Filed: June 7, 1976

[51] Int. Cl.[2] ..... A43B 23/00; A43B 5/00

[52] U.S. Cl. ..... 36/108; 36/129

[58] Field of Search ..... 36/129, 83, 91, 106, 36/108

[56] References Cited

U.S. PATENT DOCUMENTS

| | | | |
|---|---|---|---|
| 2,660,813 | 12/1953 | Shapiro | 36/129 |
| 2,758,394 | 8/1956 | Whitlock | 36/129 |
| 2,958,962 | 11/1960 | Griffi | 36/108 |

*Primary Examiner*—Patrick D. Lawson

*Attorney, Agent, or Firm*—Malin & Haley

[57] ABSTRACT

An athletic shoe constructed so as to maintain the wearer's heel out of contact with the ground is beneficial both for training and for competitive uses.

4 Claims, 3 Drawing Figures

ATHLETIC TRAINING SHOE

BACKGROUND OF THE INVENTION

The invention disclosed and claimed herein relates generally to the field of apparel, and, specifically, to the field of athletic shoes.

It has long been recognized by those skilled in the art that an athlete's ability to run effectively is dependent upon the use by the athlete of several techniques, among which are keeping his head and shoulders oriented upright, elevating his knees during the stride, and coordinating his arm and leg motions. Perhaps the most important technique applied by a runner in order to increase his running skill is that of running "on his toes", by which term is meant that the runner maintains his heels out of contact with the ground and supports each stride on that portion of his foot from the tips of his toes to a point just to the rear of the ball of his foot. By using such a technique during training, the runner vastly increases the strain on all his leg muscles in general and in particular on the muscles of the calf. By training in such a manner the rate of calf muscle development is increased. In addition, by so doing, the runner increases his pace and therefore his speed, due in part to the fact that, in running "on his toes" the runner has a tendancy to lean forward and assume a position in which he must run to keep from falling forward and that he uses half the surface area of the sole as opposed to using all of the surface area as he would tend to do with conventional shoes. By so increasing his pace during training, the runner will tend to develop better lung capacity more rapidly.

Naturally, the degree to which the runner pitches his body forward by running on his toes will vary with the type of race to be run. For example, sprinters will pitch their weight precariously forward while intermediate distance runners will have a tendancy to run in a more upright posture, and runners specializing in long distance events such as the 10,000 meter or the marathon will tend to run in an almost erect posture. Naturally, the further forward the runner shifts his weight, the farther his heel will be from the ground and the higher the runner will be "on his toes". Nevertheless, all runners will tend to run "on their toes" to at least a minimum extent. It is known that among land animals, the higher the arch of the foot, the swifter the animal will be.

For the very reason that running "on one's toes" is beneficial to a runner's competitive development, it is also contrary to his natural tendancy which is to initially contact the ground with the heel and, throughout the stride, shift the weight forward from the heel to the ball of the foot until the foot loses contact with the ground during the forward stride. It strengthens the thigh muscles on all sides and the calf muscles with a tendancy to develope them elongated as a result of the body posture used. Elongated muscles are most important for better reflex and more coordination. The shoe takes much stress off the ankles due to the fact that the weight is shifted to the upper leg muscles.

It is therefore an object of this invention to provide an athletic shoe which may be used to train runners to run on their toes.

It is a further object of this invention to provide an athletic shoe which may be used by trained runners during actual competition in order to aid in maintaining the "on the toes" posture.

SUMMARY

It has now been discovered that an athletic shoe constructed so as to maintain the wearer's heel out of contact with the ground and to maintain the wearer's weight entirely on the balls of his feet will accomplish those objects set forth hereinabove. Such a shoe may be constructed from conventional materials by employing a novel, dual-plane sole construction wherein a first sole plane, beneath the wearer's toes and adapted to contact the ground, intersects with a second sole plane immediately behind the ball of the wearer's foot which second plane angles upward and backward to the wearer's heel. The angle may be stabilized by inserting a rigid tongue in the second sole plane extending from the rear of the ball of the wearer's foot underneath the instep to the forward portion of the wearer's heel. In a preferred embodiment of the shoe, the first plane extends beyond the point of intersection with the second plane to form a ridge which diminishes the tendency of the wearer to fall back on his heels.

DESCRIPTION OF THE PREFERRED EMBODIMENT

A complete understanding of this invention will be gained by those skilled in the art from the following discussion with reference to the drawings.

Figure 1:
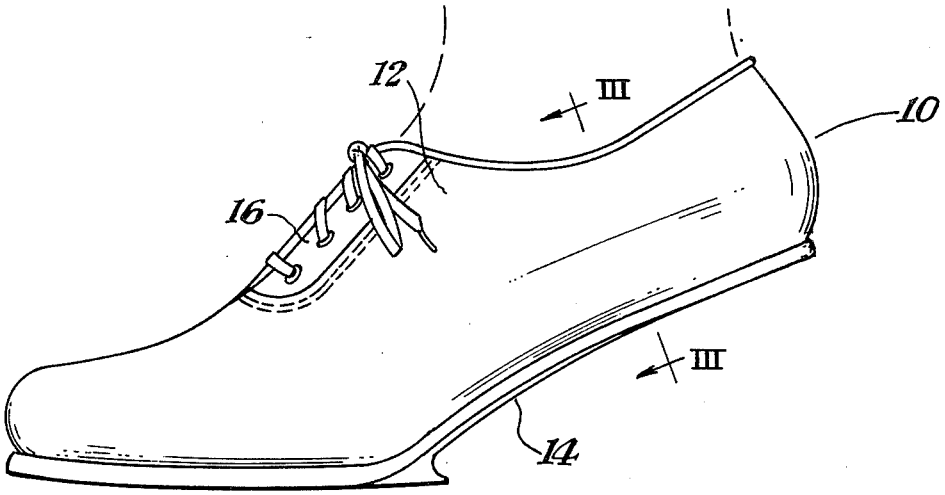
FIG. 1 is a side view of the athletic shoe constructed in accordance with the present invention.
Figure 2:
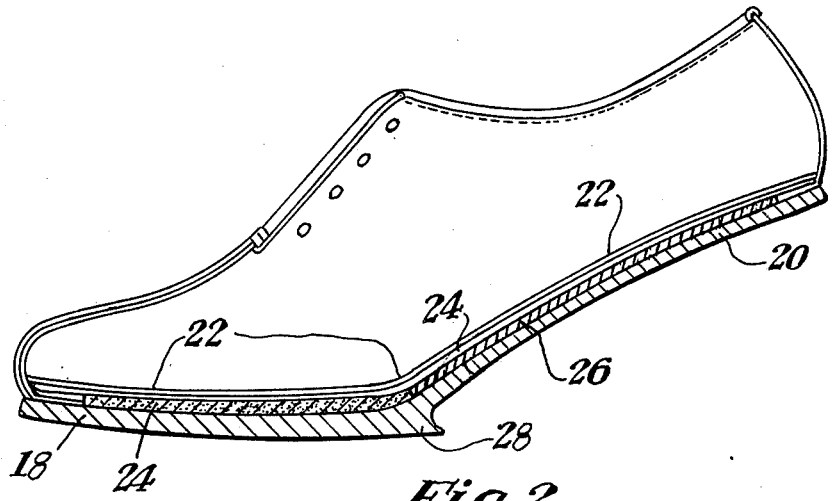
FIG. 2 is a cross section of the shoe shown in FIG. 1 along the midline thereof.
Figure 3:
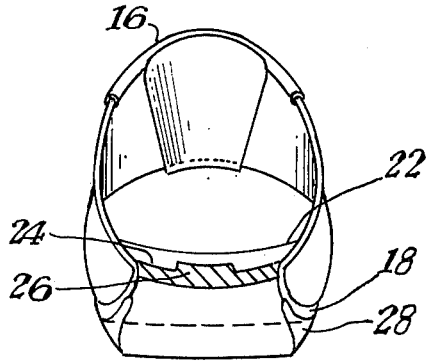
FIG. 3 is a cross sectional view of the athletic shoe taken along the line III of FIG. 1.

Referring to FIGS. 1, 2 and 3, there is seen an athletic shoe, generally referred to by the numeral 10, which has an upper portion, 12, surrounding the top and sides of the wearer's foot and a lower portion, 14, which covers the bottom of the wearer's foot. Upper portion 12 is generally adapted to be loosened so as to admit the wearer's foot and to be tightened about the wearer's foot during use by any conventional means such as conventional eyelet-shoelace means, 16. The remainder of upper portion 12 may be of unitary construction, or in the alternative, may be made up of several separate pieces which are sewn or otherwise attached to each other and to bottom portion 14.

Referring to FIG. 2, the construction of the sole is seen to be comprised of several parts. Among these parts are a first sole plane, 18, second sole plane, 20, insole, 22, filler, 24, comprising foam rubber or the like, and rigid arch support, 26, fabricated from metal or the like. In addition, the preferred embodiment of my athletic shoe is equipped with an extension, 28, of sole 18 extending rearwardly beyond the point of intersection of sole 18 with sole 20.

In use, the shoe shown in FIGS. 1–3 is constructed so as to tend to maintain the heel of the wearer at a specified distance above the ground. This tendency is imparted to the shoe both by the dual-plane sole construction and by the rigid arch support, 26, which tends to maintain the second sole plane of the shoe in a linear alignment. By so doing, rigid support 26 tends to maintain the angle between first sole plane, 18 and second sole plane, 20. Thus, if, during use, the wearer allows his heel to come in contact with the ground his toes will tend to be elevated out of contact with the ground. In addition, in the preferred embodiment of my invention, sole extension 28 will tend to stabilize the wearer's foot position on the balls of his feet and will tend to prevent the runner from leaning back and making contact between his heel and the ground.

Thus, an athletic shoe constructed in accordance with the preceeding description will tend to force the wearer to walk or run "on his toes" and will therefore aid in the development of good running habits in the wearer. In addition, due to the increased forward pitch of the runner's body due to the assumption of such a stance, the runner's leg muscles wind and speed will all be benefitted. In addition to its use as a training shoe for inexperienced runners, my invention, when equipped with conventional spikes may be used by skilled runners during competition. Such use will benefit the runner in that during the run the user will feel a thrusting forward and balancing sensation caused by the expansion and contraction within the area of the two intersecting planes. In addition, the shoe may be used therapeutically for people with weak ankles.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved athletic training shoe having an upper portion secured to a lower portion wherein the improvement comprising:

said lower portion being of unitary, one-piece construction and includes three distinct lower portion segments, a first segment having an end and a rearward extending surface for supporting the toes and the ball of the foot of a wearer, a second segment connected to said first segment and extending rearward for supporting a portion of the foot immediately behind the ball of the foot, and a third segment connected to the second segment and extending rearward to support the arch of the foot and the heel of the foot, said second segment adapted to position the first segment at an obtuse angle to said second segment and said third segment to prevent the third segment from contacting a horizontal plane at the same time as said first segment contacts said horizontal plane.

2. An athletic shoe adapted to be worn on an athlete's foot comprising:

an upper portion surrounding the top and sides of said foot, a dual-plane bottom portion being of unitary, one-piece construction secured to said upper portion about the outer edges thereof, having a first planar portion extending from the toe of the wearer's foot to a position adjacent the rear of the ball of the wearer's foot and having a second planar portion extending from the position adjacent the rear of the ball of the wearer's foot to the heel of said shoe and intersecting said first planar portion at an interplanar angle of from about 170° to about 120°, so constructed and arranged that said shoe will aid the athlete in maintaining his heel out of contact with the ground, and intermediate wedge shaped portion having one side in said first planar portion and a second side in said second planar portion both of which meet generally at said intersecting of said first planar portion and said second planar portion, said wedge shaped portion including supportive structure rearward of said intersection of said first side and second side of said wedge shaped portion.

3. The athletic shoe as set forth in claim 2 additionally comprising:

a rigid support plate interiorly of, and integral with, said second planar portion.

4. The athletic shoe as set forth in claim 3 wherein:

said wedge shaped portion is extended beyond the point of intersection with said first portion and said second portion and rigidly connected to said support plate and so constructed and arranged that a ridge is formed reducing the tendency of said athlete's heel to come into contact with the ground.

* * * * *